US011051566B2

(12) United States Patent
Richards

(10) Patent No.: US 11,051,566 B2
(45) Date of Patent: Jul. 6, 2021

(54) KNEE PAD DEVICE

(71) Applicant: Lee E. Richards, Whitefield, ME (US)

(72) Inventor: Lee E. Richards, Whitefield, ME (US)

( * ) Notice: Subject to any disclaimer, the term of this patent is extended or adjusted under 35 U.S.C. 154(b) by 278 days.

(21) Appl. No.: 15/761,859

(22) PCT Filed: Sep. 29, 2016

(86) PCT No.: PCT/US2016/054279
§ 371 (c)(1),
(2) Date: Mar. 21, 2018

(87) PCT Pub. No.: WO2017/058979
PCT Pub. Date: Apr. 6, 2017

(65) Prior Publication Data

US 2018/0263307 A1 Sep. 20, 2018

Related U.S. Application Data

(60) Provisional application No. 62/235,598, filed on Oct. 1, 2015.

(51) Int. Cl.

| | |
|---|---|
| ***A41D 13/06*** | (2006.01) |
| ***A63B 71/12*** | (2006.01) |
| ***A41D 13/015*** | (2006.01) |
| ***A41D 13/05*** | (2006.01) |

(52) U.S. Cl.
CPC ..... *A41D 13/065* (2013.01); *A41D 13/0153* (2013.01); *A41D 13/0568* (2013.01); *A63B 71/1225* (2013.01); *A41D 2300/33* (2013.01)

(58) Field of Classification Search
CPC ..... A41D 13/06; A41D 13/0556; A41D 13/0562; A41D 13/065; A41D 13/0568; A41D 2300/33; A41D 13/0153; A41D 13/0543; A63B 71/1225; A63B 2071/125; A63B 2071/1258; A63B 71/12; A63B 2071/1241; A63B 2071/1266
USPC ..... 2/1, 22, 24, 62, 455, 911
See application file for complete search history.

(56) References Cited

U.S. PATENT DOCUMENTS

| | | | | | |
|---|---|---|---|---|---|
| 909,215 | A * | 1/1909 | Pierce et al. | A63B 71/1225 | 2/22 |
| 1,253,260 | A * | 1/1918 | Levinson | A63B 71/12 | 2/462 |
| 2,640,989 | A * | 6/1953 | Woodward | A41D 13/0568 | 2/22 |
| 3,772,704 | A * | 11/1973 | Carbonneau | A63B 71/1225 | 2/22 |

(Continued)

FOREIGN PATENT DOCUMENTS

| | | | | |
|---|---|---|---|---|
| CN | 101357004 B | | 4/2011 | |
| GB | 1560622 A | * | 2/1980 | A41D 13/065 |

(Continued)

*Primary Examiner* — Jameson D Collier
(74) *Attorney, Agent, or Firm* — Jeffrey Joyce, Esq.

(57) ABSTRACT

A knee pad support frame that is a molded component having an upper section and lower section that are coupled together by a flexible connector. The upper section has a knee pocket shape and both the upper and lower sections have ribbing to provide the necessary strength and rigidity. Additional molded components are provided for attaching the frame to the other knee pad components such as a cushion, cover and securing strap.

11 Claims, 12 Drawing Sheets

(56) References Cited

U.S. PATENT DOCUMENTS 4,633,529 A * 1/1987 Litz ..... A63B 71/1225 2/22
4,674,157 A * 6/1987 Litz ..... A63B 71/1225 2/22
4,888,826 A * 12/1989 Parsons, Jr. ..... A63B 71/1225 2/22
5,297,294 A * 3/1994 Washick ..... A63B 71/1225 2/22
5,611,080 A * 3/1997 Skottheim ..... A41D 13/0568 2/16
5,794,261 A * 8/1998 Hefling ..... A41D 13/065 2/16
6,178,555 B1 * 1/2001 Williams ..... A41D 17/00 2/22
6,687,912 B2 * 2/2004 Collins ..... A41D 13/0568 2/22
6,795,974 B1 * 9/2004 Howell ..... A41D 13/065 2/22
7,096,507 B1 * 8/2006 Bolden ..... A41D 13/05 2/22
2003/0154540 A1 * 8/2003 Nishimoto ..... A63B 71/1225 2/220
2006/0096000 A1 5/2006 Romero et al.
2008/0168589 A1 * 7/2008 Richards ..... A41D 13/065 2/24
2010/0192269 A1 * 8/2010 Saranga ..... A41D 13/0543 2/24
2012/0233736 A1 * 9/2012 Tepper ..... A41D 13/0153 2/24
2013/0025017 A1 * 1/2013 Chen ..... A63B 71/1225 2/22
2014/0259325 A1 9/2014 Behrend et al.
2014/0283275 A1 * 9/2014 Pratson ..... A41D 13/065 2/24
2016/0183609 A1 * 6/2016 Cox ..... A41D 13/0568 2/16
2019/0269996 A1 * 9/2019 Rodrick ..... A63B 71/1225

FOREIGN PATENT DOCUMENTS

GB 2177892 A * 2/1987 ..... A63B 71/1225
KR 2020110008902 U 9/2011
WO WO-9418861 A1 * 9/1994 ..... A41D 13/065
WO WO-2006055620 A2 * 5/2006 ..... A61F 5/0104

* cited by examiner

KNEE PAD DEVICE

BACKGROUND INFORMATION

Field of the Invention

The invention relates to knee pads, particularly knee pads that are intended for occupational use.

Discussion of the Prior Art

People with occupations that require spending a lot of time on one's knees, such as flooring installers and certain carpenters, often wear knee pads to protect their knees and lower legs. These occupations typically require a lot of movement, around the floor on one's knees, and also walking for one place to another. They are also activities that last for many hours each day. Due to the nature of the work, many occupational knee pads extend from the user's knee all the way down to the foot or ankle. This length helps to distribute the weight of the user's body across the length of the knee pad rather than having the user's weight bearing down on the user's knee joint. However, such a long knee pad is also heavy and cumbersome to wear, which is not desirable in all occupational settings.

What is needed, therefore, is a shorter less cumbersome knee pad that extends below the knee but not to the user's foot and that is still a strong and durable kneepad that will hold its form throughout the course of many work days, yet be flexible enough to stay in position while a user wearing them walks about.

BRIEF SUMMARY OF THE INVENTION

The invention is a support frame for a knee pad that extends over a user's knee and a short distance down the user's shin, ending a significant distance above the user's foot, the frame having upper and lower sections that are coupled together by a flexible connecter. The frame is a molded component, wherein the upper section has a knee pocket shaped to fit comfortably around the knee, and the lower section extends from below the knee down along the user's shin. Ribbing is provided to strengthen the frame and allow for the required flexibility as the user moves about, bending and straightening his or her leg.

Modular molded components including buckle mount tabs, wire tie pockets and strap retention guides in the form of slots are provided in the frame to allow for convenient and durable assembly of the knee pad. For example, wire tie pockets are provided to help secure a cushion to the frame, the cushion then fitting against the user's leg for comfort. The strap retention guides are provided to hold straps at the proper angle to allow the knee pad to be secured in a comfortable and functional position on the user's leg. The buckle mounts are positioned at an angle coinciding with the strap retention guides to direct the angle of the strap below the back of the user's knee joint area. The frame that is constructed for the left leg is a mirror image of the frame constructed for the right leg, allowing for the consistent strap and buckle alignment position to be maintained on the user's leg.

With the inventive frame a lightweight, durable, kneepad is easily assembled and worn by the user.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

FIGS. 1-5 illustrate a support frame 10 according to the invention. The frame is a plastic molded component that has an upper section 12 that fits around the user's knee and a lower section 14 that extends down a portion of the users shin. The exact fit on the user's leg varies depending on the size of the user's knee, however, the support frame 10 generally extends a few inches below the user's knee onto the user's upper shin. The upper section 12 and lower section 14 are connected by a live hinge or flexible connector 16 that allows for the user to bend his knee comfortably while maintaining the structural integrity of the frame 10.

Figure 1:
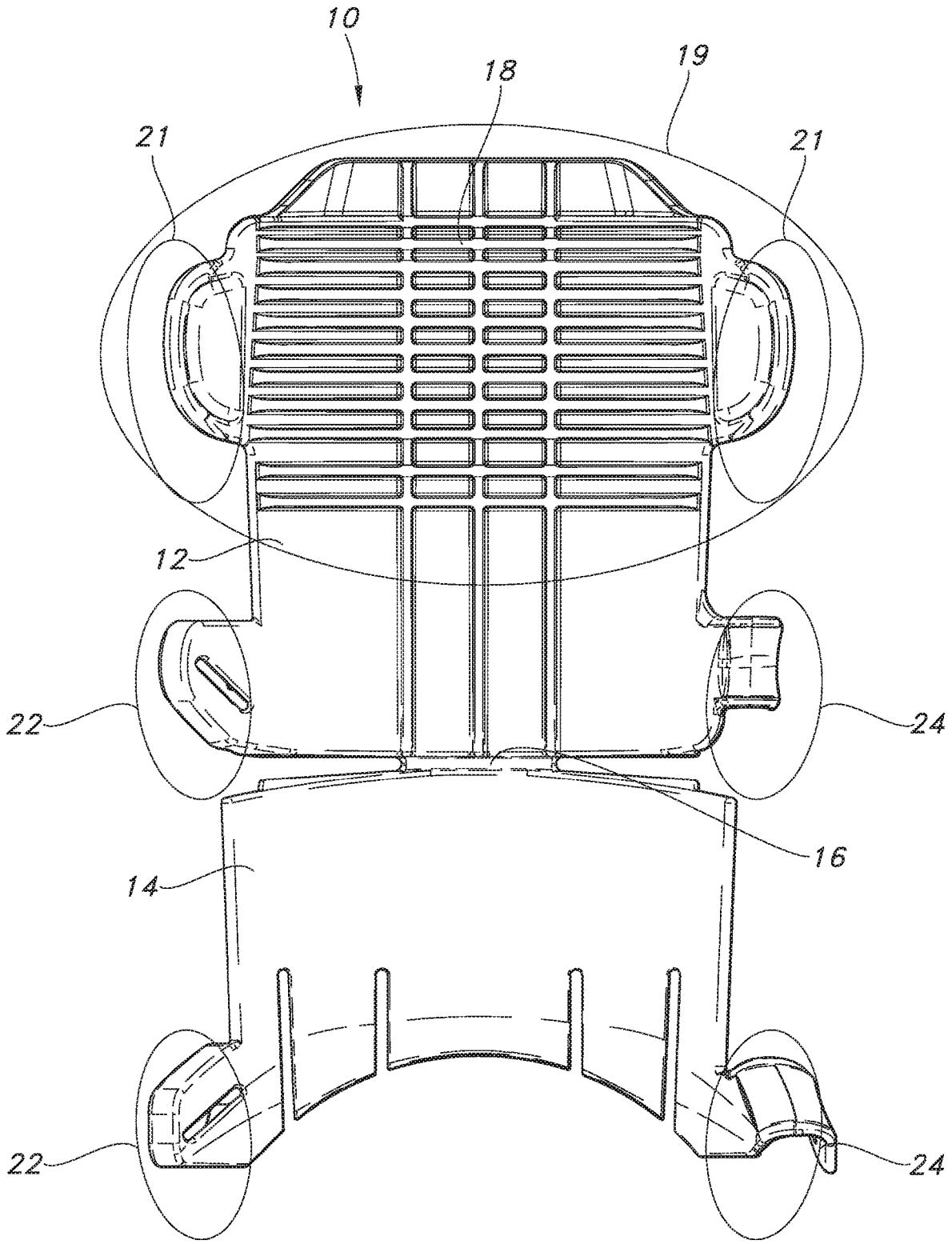
FIG. 1 is a top plan view of a knee pad frame according to the invention, showing the inner surface that faces toward the user's knee and shin when in use.
Figure 2:
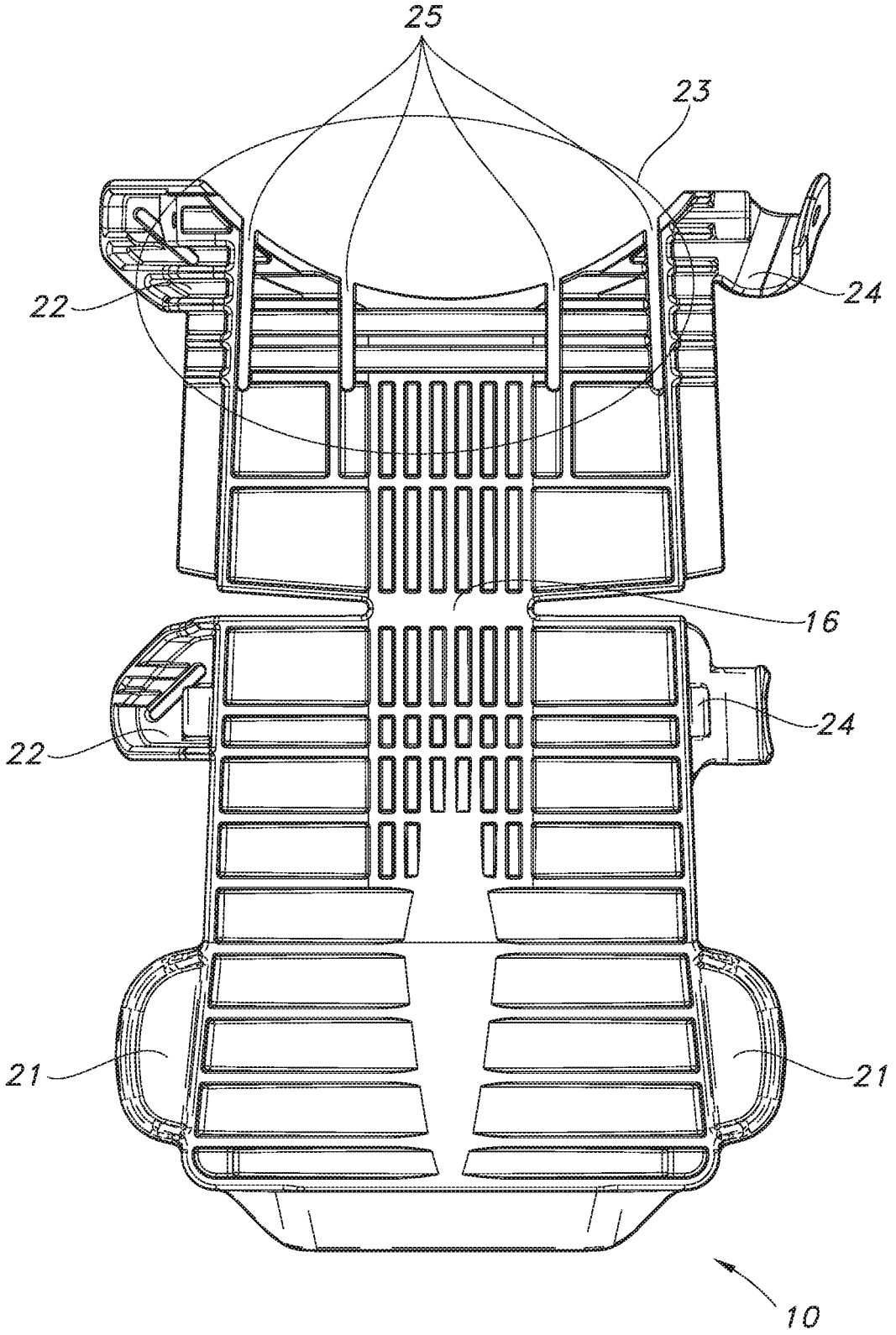
FIG. 2 is a bottom plan view of the frame, showing the outer surface that faces toward the floor when in use.
Figure 3:
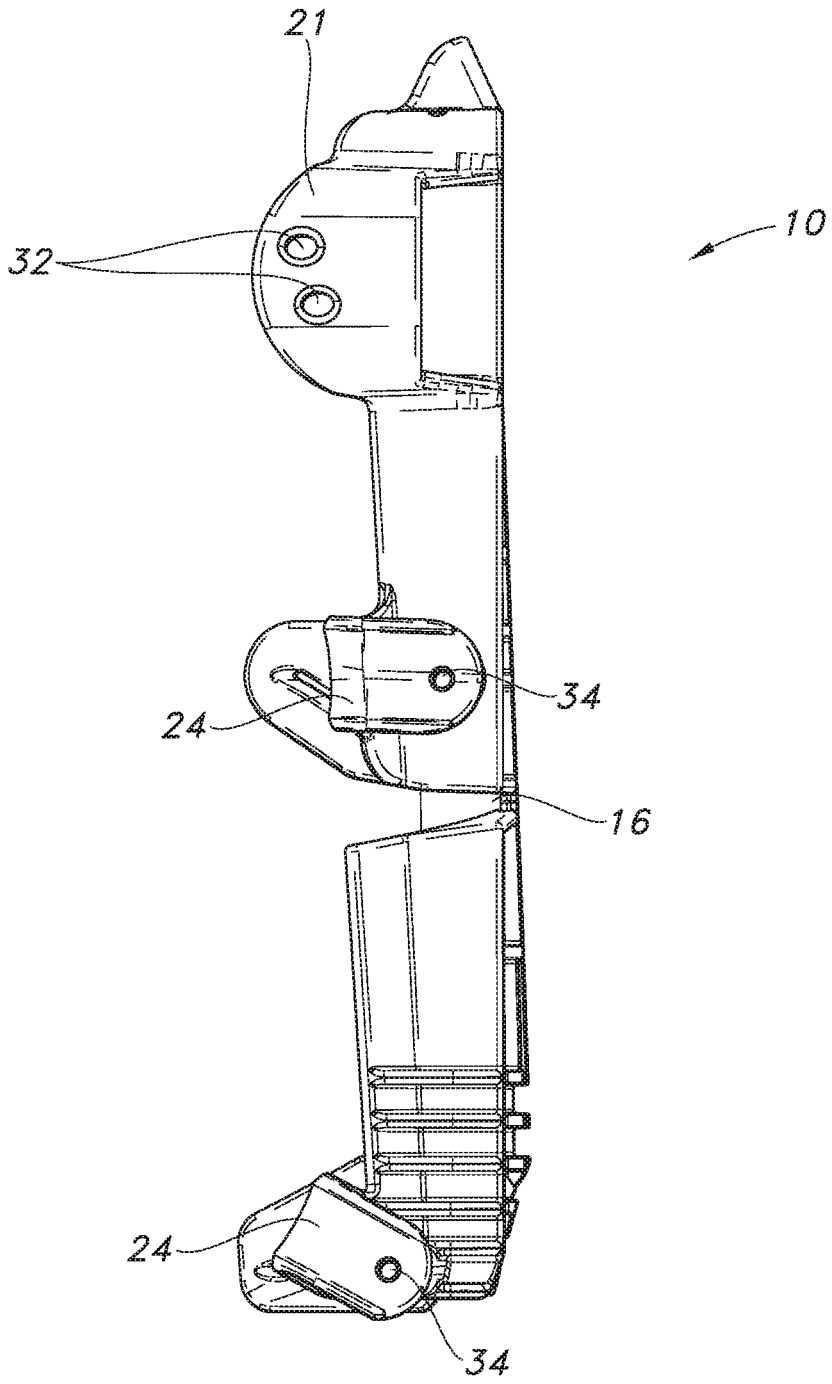
FIG. 3 is a plan view of the right side of the frame, showing molded elements for the buckle mounts and wire ties on the right side of the device.
Figure 4:
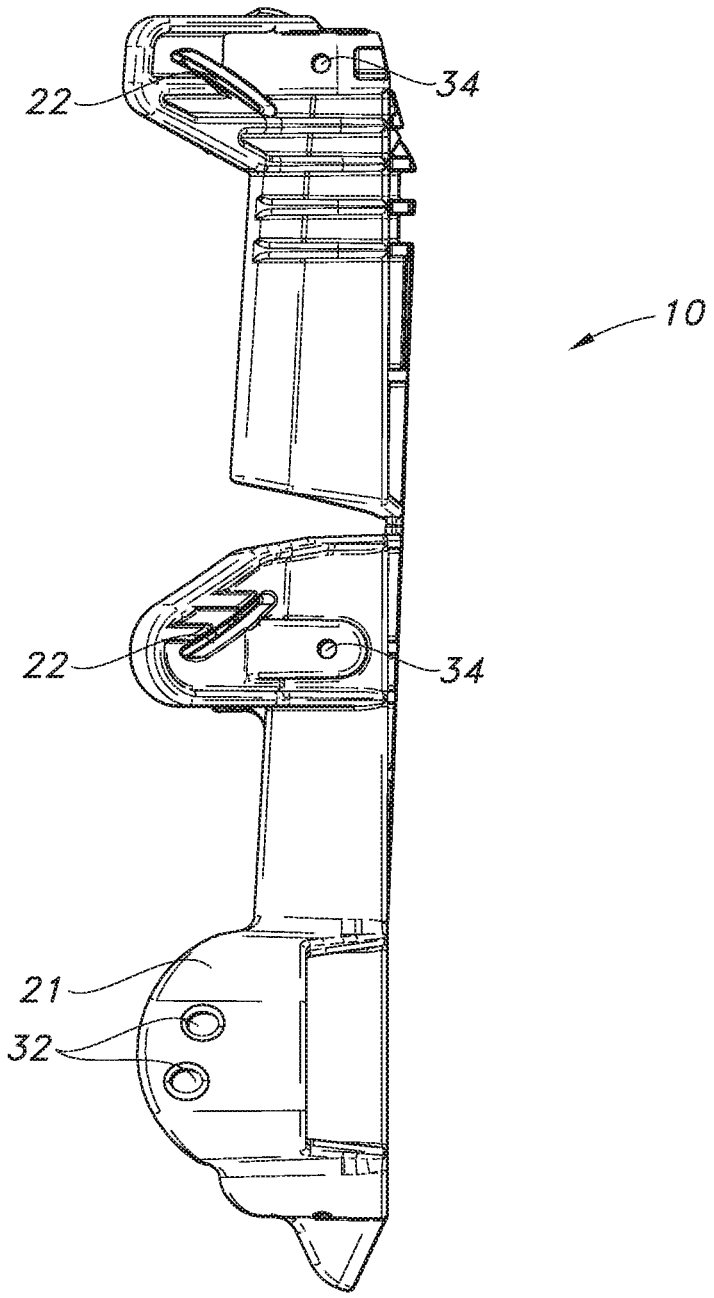
FIG. 4 is a plan view of the left side of the frame, showing molded elements for the strap retention guides and wire ties.
Figure 5:
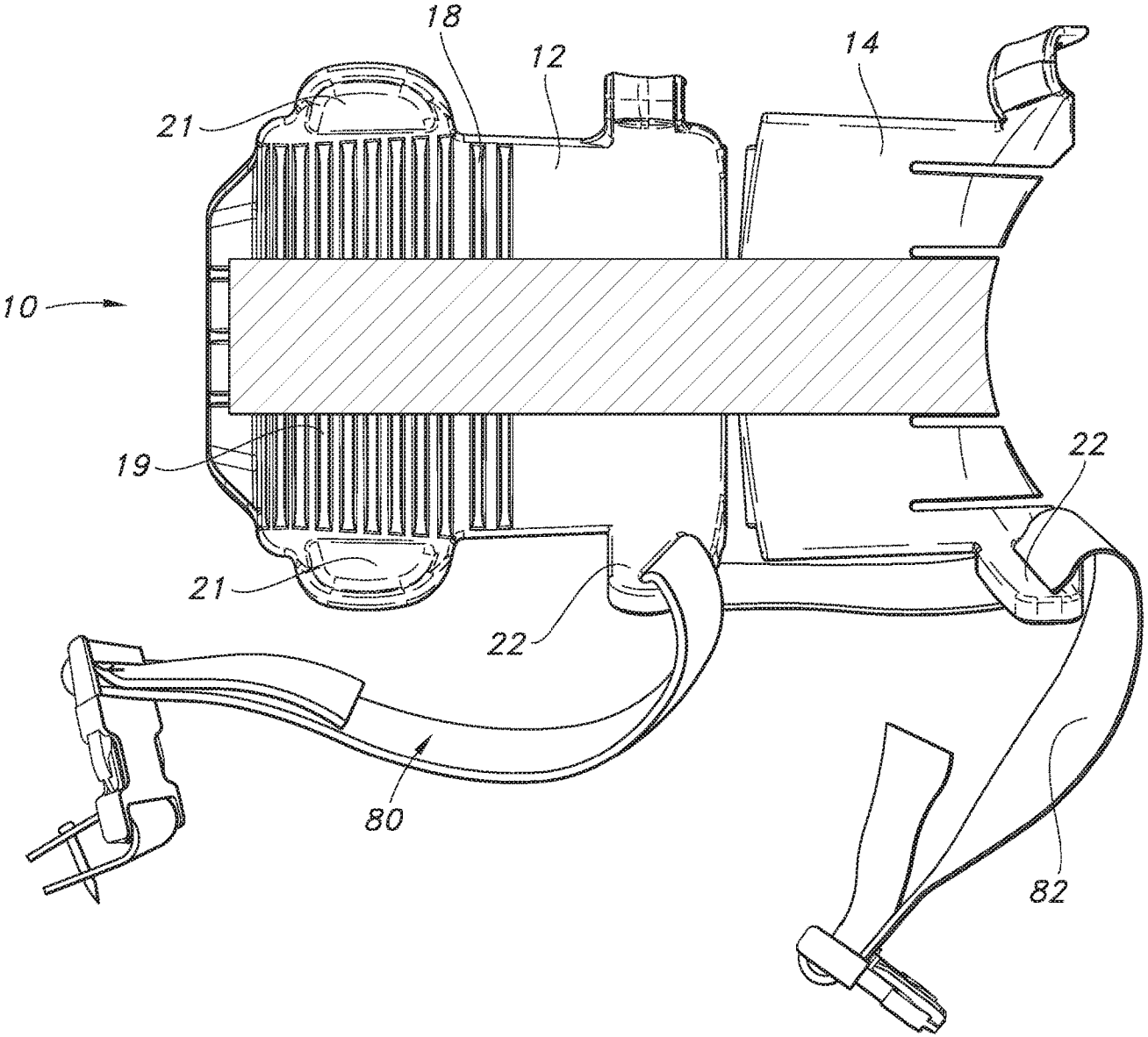
FIG. 5 is a top view of the frame, showing support straps attached to the frame.
Figure 6:
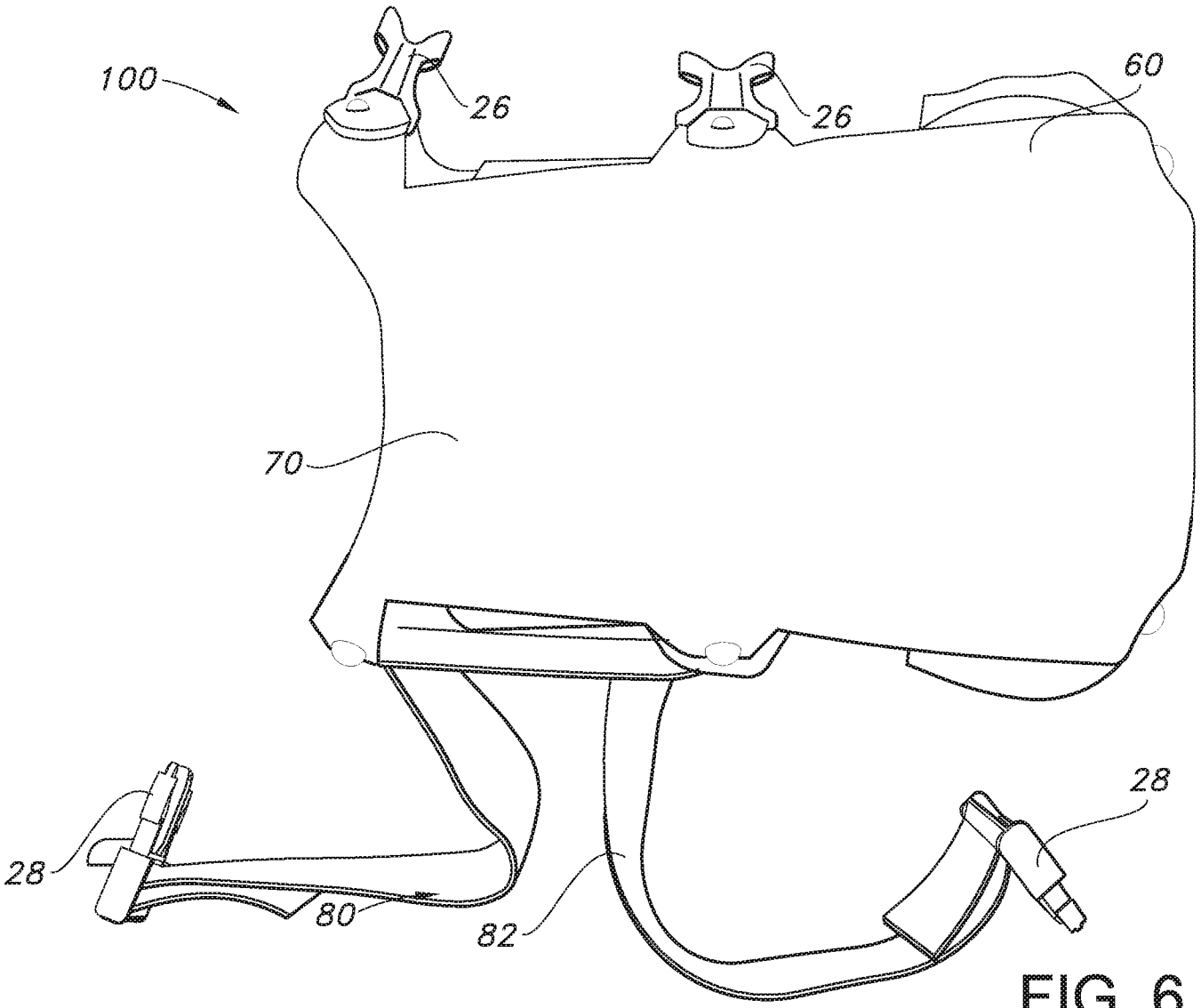
FIG. 6 is a bottom view of knee pad according to the invention, showing the outer cover attached to the knee pad frame.
Figure 7:
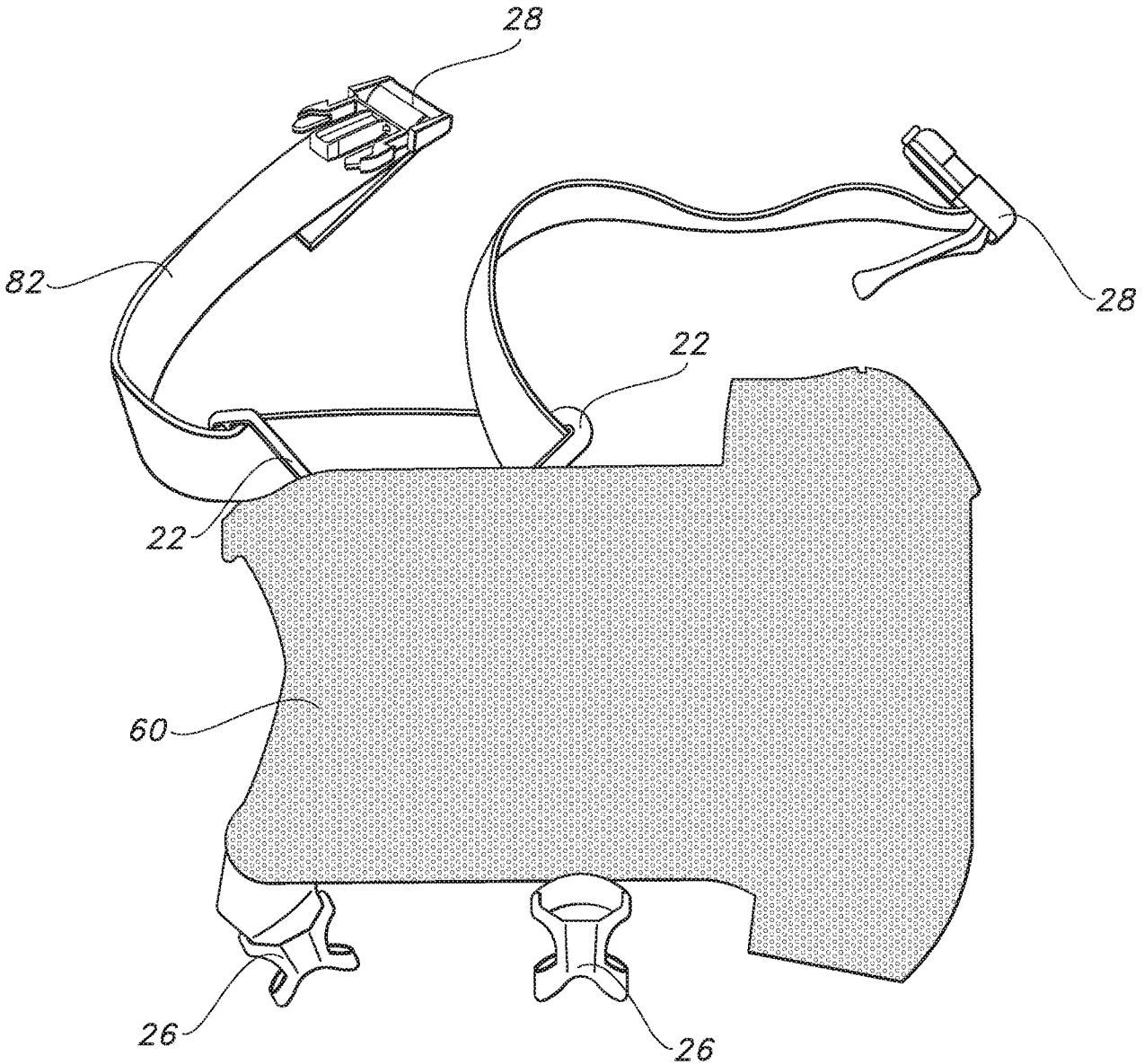
FIG. 7 is a top view of the knee pad, showing the inner surface that is in contact with the wearer's leg.
Figure 8:
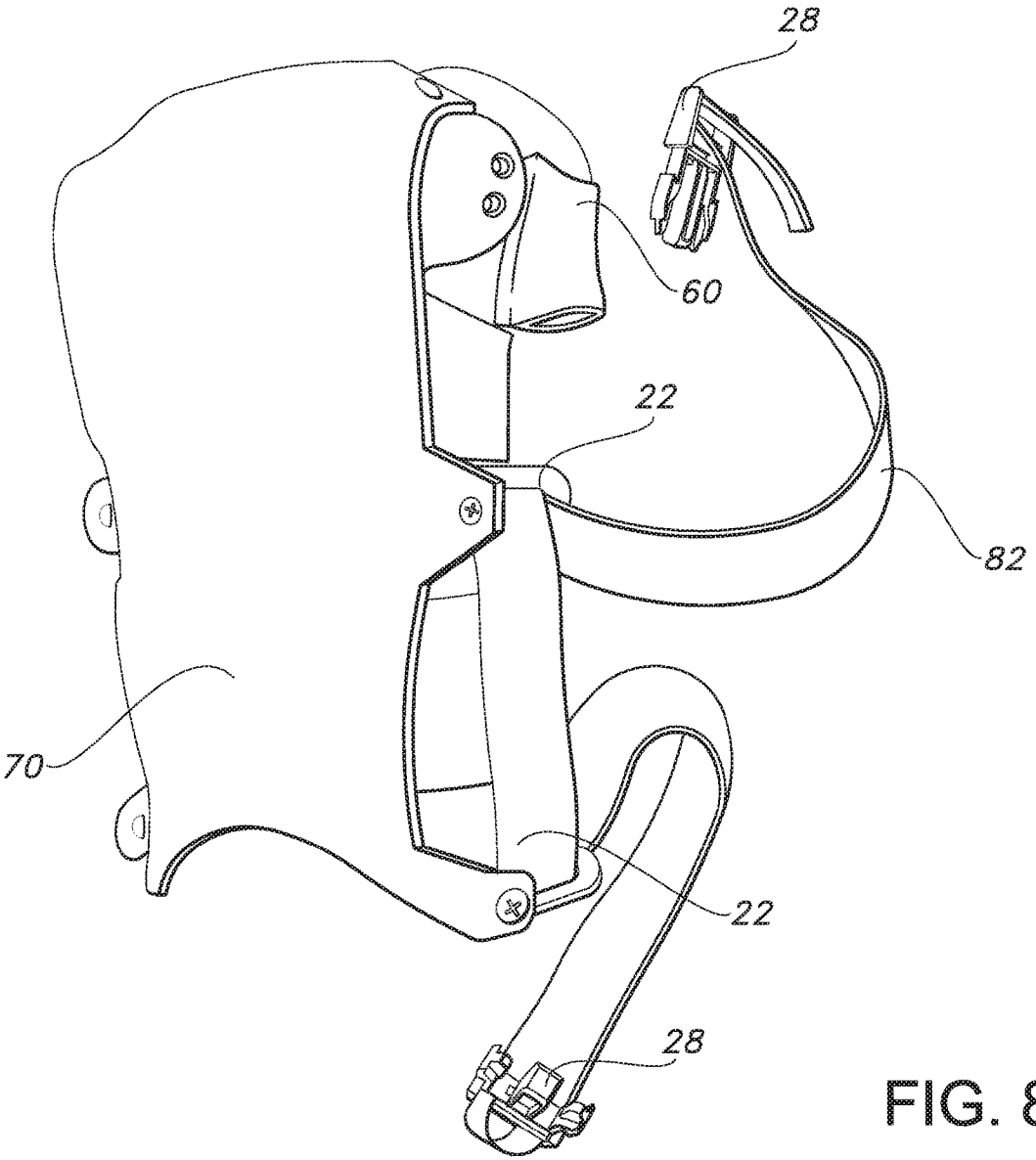
FIG. 8 is a side perspective view of the knee pad, showing strap retention guides and male buckles.
Figure 9:
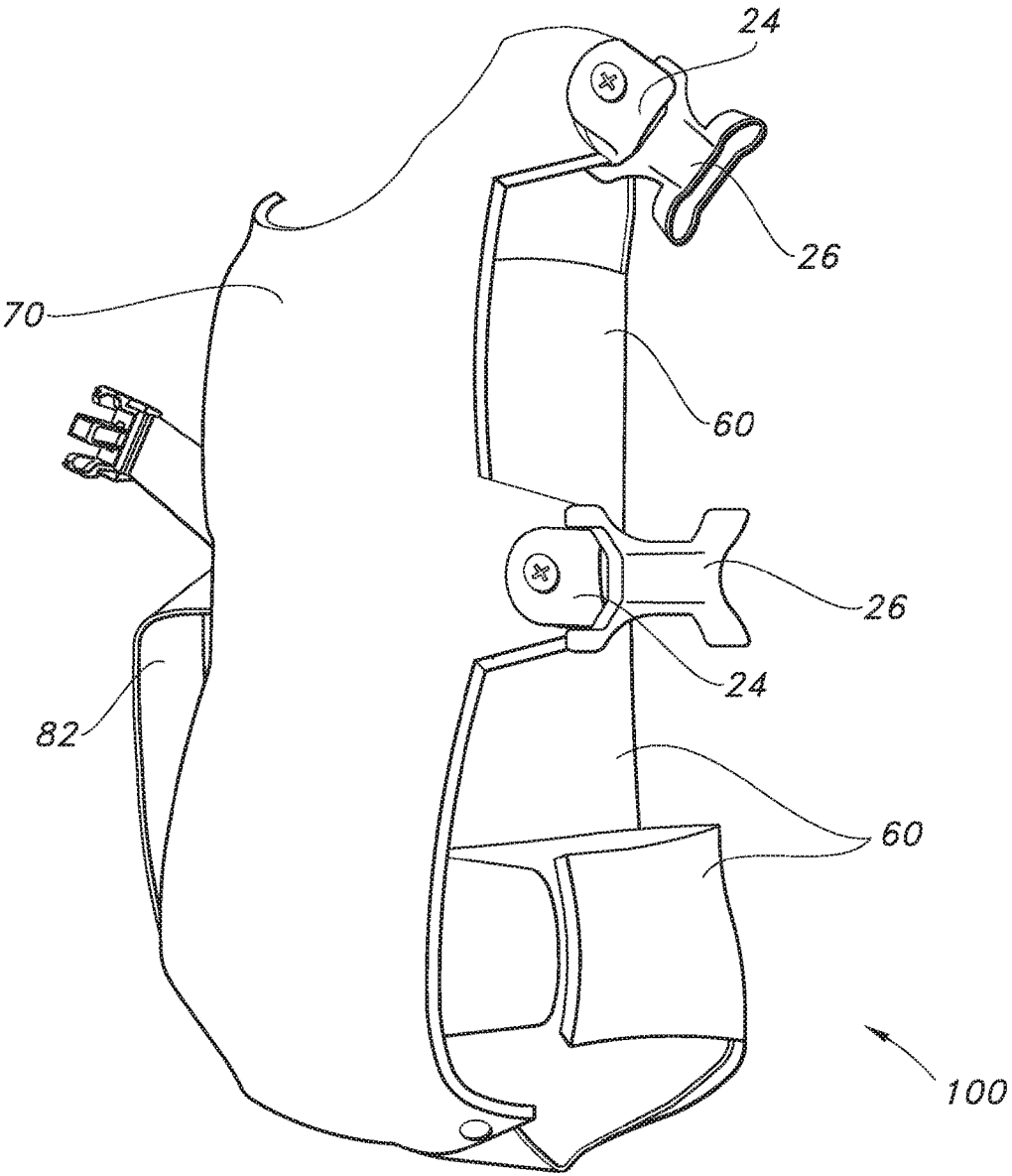
FIG. 9 is a side perspective view of the knee pad, showing buckle mounts and the female buckle elements.

FIG. 1 shows details of the inner surface of the frame 10 of a knee pad 100 (shown in FIGS. 6-10). The upper section 12 includes specially designed ribbing 18 that provides the strength for the knee pocket shape 19 that is needed for the knee pad 100 to function as the user moves about on a surface while bending and straightening his leg. FIG. 2 shows the outer surface of the frame 10 and particularly the ribbing 23 in the lower section 14 which provides strength and rigidity to an attachment means 80, shown in FIGS. 6-10, so that the kneepad maintains proper form while in use. Slots 25 provide greater flexibility at this lower section 14 and allow the frame 10 to conform to the user's lower leg circumference independently of the diameter of the leg in the area of the calf.

FIGS. 6-10 illustrate a knee pad 100 comprising the frame 10, a cushion 40 (shown in FIG. 12), an inner cover 60, an outer cover 70, and attachment means 80. The outer cover 70 comes into contact with the floor when in use, and the inner cover 60 is in contact with the user's leg. The inner cover 60 is placed over the cushion 40 and both are assembled on the inner surface of the support frame 10, and the outer cover 70 is assembled on the outer surface of the frame 10. Wire ties WT (not shown) are used to fasten the cushion 40 to the support frame 10. The cushion 40 may be further secured to the frame 10 by other suitable means, for example, by fabric hook-and-loop fasteners. The attachment means 80 includes a plurality of straps 82 and male and female buckles 28 and 26, respectively, which are affixed to the support frame 10 and are used to secure the knee pad 100 to the user's leg.

The frame 10 includes a plurality of wire tie pockets 21 that provide an area (i.e. an indentation) to receive a knot of the wire tie WT. These pockets provide an improved cushioning effect, because they prevent discomfort that could result from kneeling on the knot of the wire tie WT, particularly when the cushion 40 is in a compressed position while the user's knee is fully engaged in the knee pocket 19. The wire tie pockets 21 are particularly advantageous for users who have relatively large knees, as they would feel the pressure from wire tie knot pushing against the frame 10, were it not for the wire tie pockets 21.

The frame 10 includes a plurality of molded strap retention guides 22 that eliminate the need for add-on products and the additional mechanical fastening those products require, such as sewing, seen in the prior art. The strap retention guides 22 are angled and positioned to lock the strap in the desired position and allow the straps 82 to fit snugly about the user's leg, primarily around the user's calf and below the back of the knee joint area, for additional comfort. Having the kneepad secured in this position causes the knee pad 100 to conform to the user's leg as he moves about. The frame 10 also includes a corresponding plurality of molded buckle mounts 24 that secure the female end of buckles 26 and that are also angled, so as to secure the knee pad 100 in the most comfortable and functional position. The straps 82 are threaded through the strap retention guides 22, and male ends of buckles 28 are attached to the ends of the straps 82. The user places the knee pad 100 in position on the leg and then connects the male buckle ends 28 to the female counterparts 26.

Figure 10:
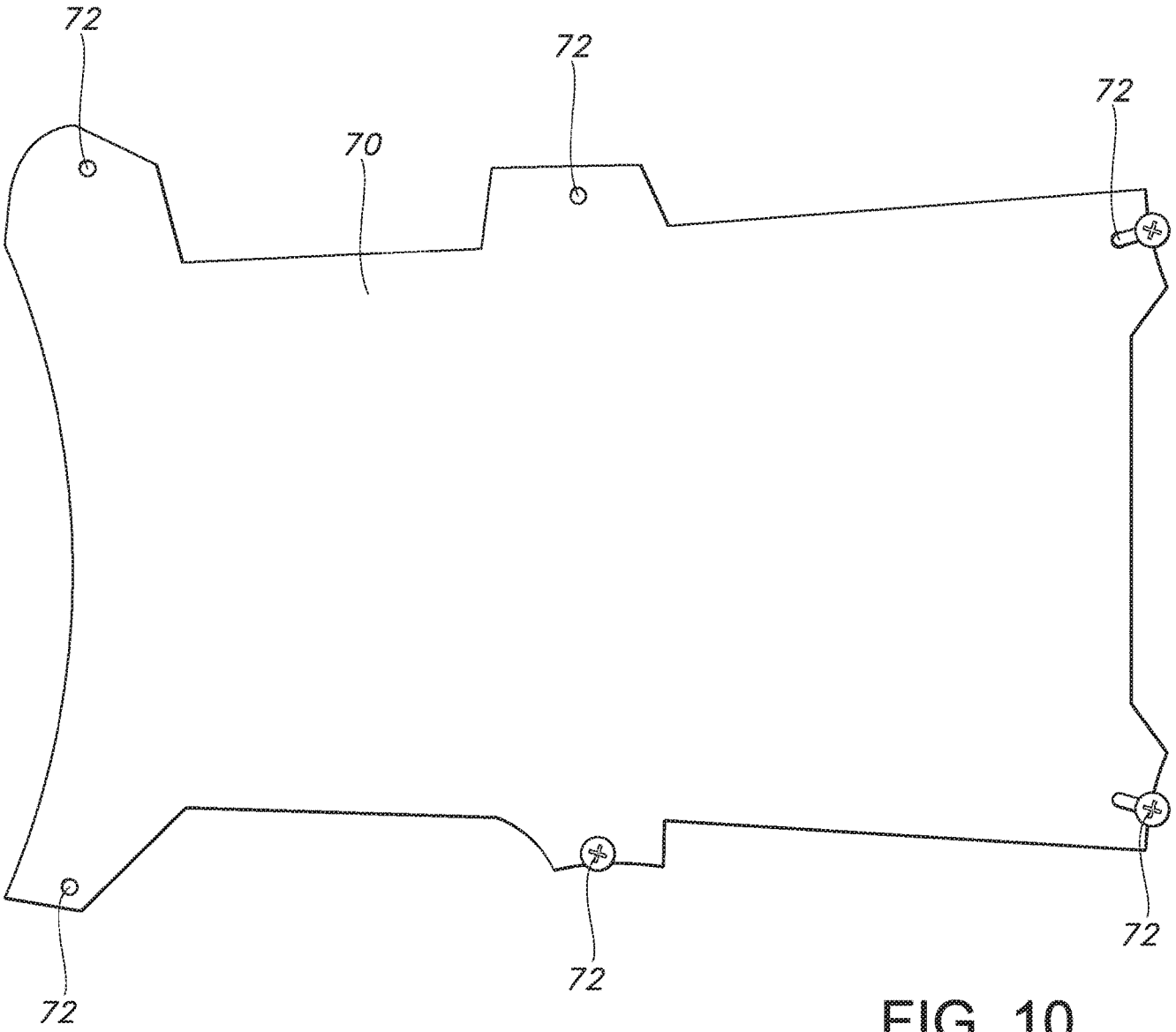
FIG. 10 is a top plan view of the outer cover.

FIG. 10 illustrates the outer cover 70 that is constructed of a composite material, such as a reinforced rubber, that is flexible enough to bend easily as the knee pad 100 is in use, but is also rugged enough to withstand repeated and substantial contact with the surface, for example a floor, roof or ground, while bearing the full weight of the user. The outer cover 70 has pre-formed holes 72 for receiving fasteners for attaching the cover to pre-formed holes 34, shown in FIGS. 7 and 8, in the outer surface of the frame 10. The outer cover 70 could also be constructed of another material, such as, for example, leather or rubber.

Figure 11:
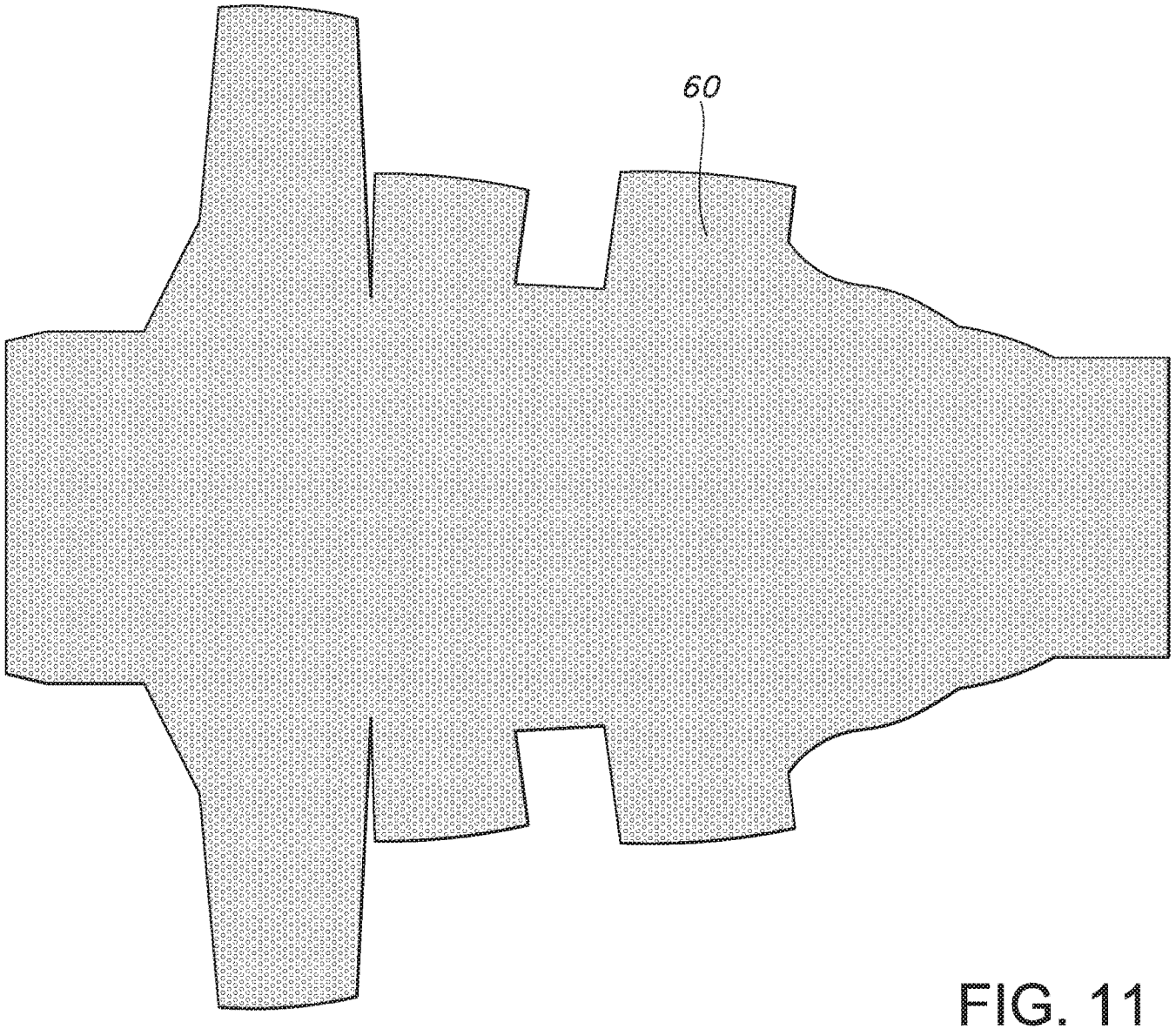
FIG. 11 is a top plan view of the inner cover.

FIG. 11 illustrates the inner cover 60 that is a thin breathable cushion that wraps around the bottom and sides of the knee pad 100 and is affixed to the frame 10 by fabric hook-and-loop fasteners. The inner cover 60 is readily removable for cleaning and/or replacement when it is worn.

Figure 12:
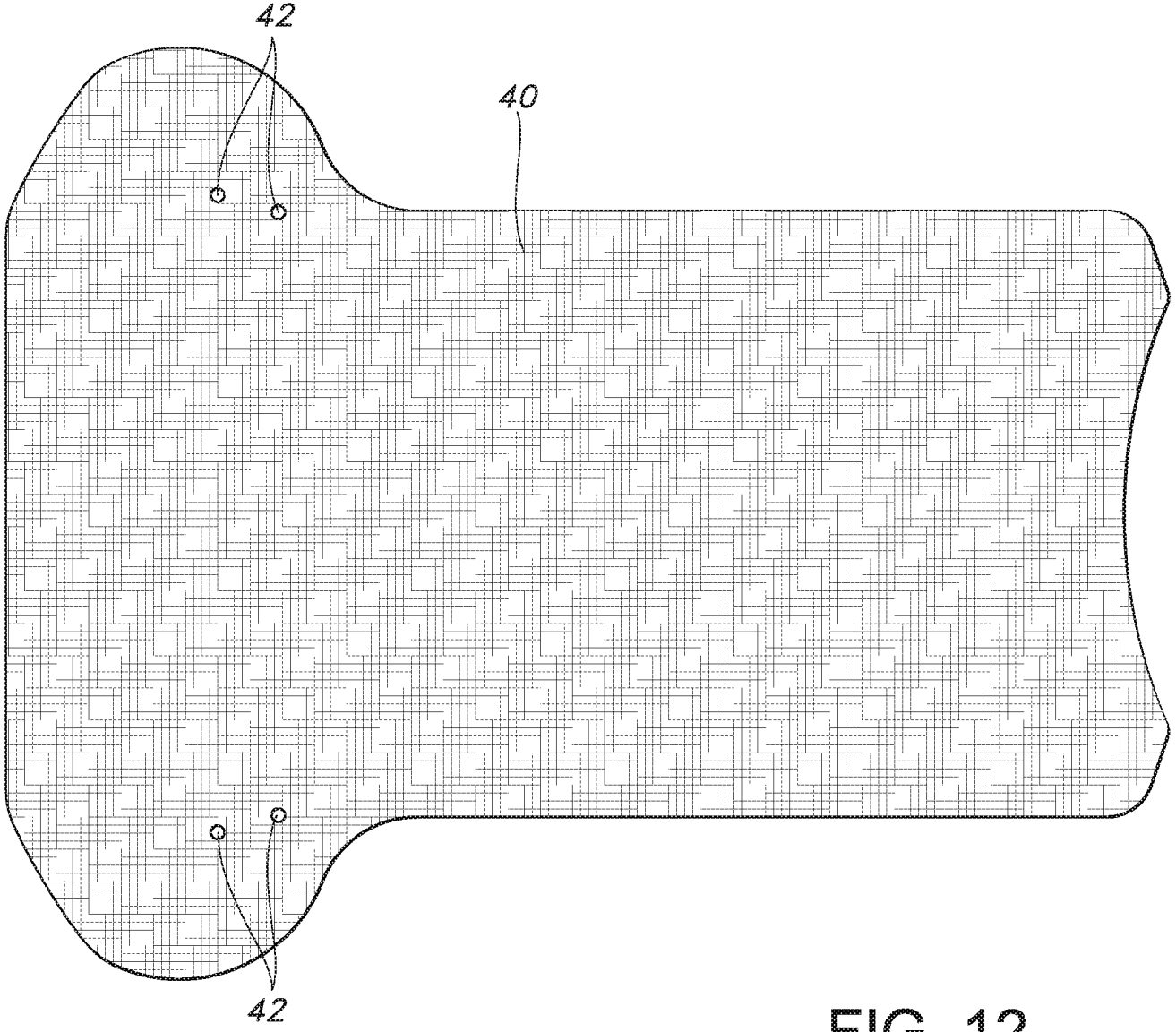
FIG. 12 is a top plan view of the cushioning pad.

FIG. 12 illustrates the cushion 40 and wire tie insertion points 42. The wire ties WT are first threaded through wire tie openings 32 in the frame 10, shown in FIGS. 3 and 4, then through a corresponding wire tie insertion point 42 in the cushion 40 and back through the opposite wire tie insertion point 42, then through the corresponding wire tie opening 32 where it is secured in a common manner. The manner in which the cushion 40 is secured to the frame 10 compresses the cushion between the wire tie openings 32 and the insertion points 42, creating a knot. The wire tie pocket 21 allows the knot to nest inside the frame 10 so that the user will not feel the knot regardless of how much pressure is applied to the knee pad 100.

It is understood that the embodiments described herein are merely illustrative of the present invention. Variations in the construction of the knee pad may be contemplated by one skilled in the art without limiting the intended scope of the invention herein disclosed and as defined by the following claims.

What is claimed is:

1. A support frame for a knee pad that is attachable to a user, the support frame comprising:

an upper section that has an inner surface with a knee pocket shaped to conform to a knee portion of a leg of the user and a lower section having an inner surface that is shaped to conform to an upper shin section of the leg of the user, and a live hinge connecting the upper section to the lower section so as to allow the upper section and lower section to flex relative one another;

a plurality of attachment elements configured to secure the support frame to the leg of the user that include strap retention guides and buckle mounts, the strap retention guides and the buckle mounts are angled so as to secure a strap in a manner that is configured to cause the support frame to conform to the user's leg below the back of the knee joint area, at least one of the strap retention guides located on a first side at a bottom end of the lower section and at least one of the buckle mounts located on a second side at the bottom end of the lower section, the second side being oppositely positioned from the first side;

the lower section including a plurality of vertically oriented slots that begin at the bottom end of the lower section and extend at least part way into the lower section;

wherein when the attachment elements secure the support frame to the user, the upper surface fits securely around the knee portion of the leg of the user while the lower section's vertically oriented slots cause the lower section to conform to the a circumference of the upper shin section of the leg of the user independently of a diameter of the upper shin section of the leg of the user; and wherein the upper section has a top end, the upper section having a first length measured from the top end to the live hinge, and the lower section having a second length measured from the live hinge to the bottom end, and wherein the first length is greater than the second length.

2. The support frame of claim 1, wherein the lower section has an outer surface having ribbing that provides strength and rigidity to the plurality of attachment elements and the upper section's inner surface has ribbing that provides structural frame support to the knee pocket.

3. The support frame of claim 2, wherein one or more of the plurality of attachment elements are receptacles that are adapted to receive a knot.

4. The support frame of claim 1, wherein one or more of the plurality of attachment elements is a strap and wherein a first end of a buckle is secured on the strap and one or more of the buckle mounts are configured for holding a second end of the buckle for attaching the strap to the support frame.

5. The support frame of claim 1, wherein the support frame is a single molded component.

6. A support frame for a knee pad that is attachable to a user, the support frame comprising:

a single molded component having an upper section that has an inner surface with a knee pocket shaped to conform to a knee portion of the user's leg and a lower section having an inner surface that is shaped to conform to an upper shin section of the user's leg, and alive hinge connecting the upper section to the lower section so as to allow the upper section and lower section to flex relative one another, and a plurality of attachment elements for securing the support frame to the user's leg and for securing the support frame to a cushion;

the plurality of attachment elements including molded-in buckle mount tabs and molded-in retention guides;

wherein the molded-in buckle mount tabs respectively protrude outward from sides of the support frame and are components that are molded in to the support frame that are configured to secure one side of a buckle to one of the sides the support frame;

wherein the molded-in retention guides are components that protrude outward from one of the sides of the support frame and are molded in to the support frame, each retention guide having an open slot that is sized to allow a strap to pass through the retention guide, and configured to secure the strap on one of the sides of the support frame that is opposite from the buckle mount tabs; and wherein the upper section has a top end and the lower section has a bottom end, wherein the upper section has a first length measured from the top end to the live hinge, and the lower section has a second length measured from the live hinge to the bottom end, and wherein the first length is greater than the second length.

7. The support frame of claim 6, wherein the molded-in strap retention guides and molded-in molded buckle mounts are angled and configured so as to secure a strap in a manner that is configured to cause the support frame to conform to the user's leg below the back of the knee joint area.

8. The support frame of claim 7, wherein the lower section has an outer surface having ribbing that provides strength and rigidity to the plurality of attachment elements and the upper section's inner surface has ribbing that provides structural frame support to the knee pocket.

9. The support frame of claim 8, wherein the lower section includes a plurality of vertically oriented slots that begin on the bottom end of the lower section and extend at least part way into the lower section; and wherein when the attachment elements secure the support frame to the user, the upper surface fits securely around the knee portion of the leg of the user while the lower section's vertically oriented slots cause the lower section to conform to a circumference of a lower leg portion of the user independently of a diameter of the user's lower leg portion.

10. A support frame for a knee pad, the support frame comprising:

a single molded component having an upper section that has an inner surface with a knee pocket shaped to conform to a knee portion of a user's leg and a lower section having an inner surface that is shaped to conform to an upper shin section of the user's leg, and alive hinge connecting the upper section to the lower section so as to allow the upper section and lower section to flex relative one another, and one or more attachment elements for securing the support frame to the user's leg and for securing the support frame to a cushion;

the plurality of attachment elements including tie pockets that are molded components that protrude outward on each side of the knee pocket and have respective open indentations that are configured to respectively receive a knot from a respective connector that is used to secure the cushion to the support frame; and wherein the upper section has a top end and the lower section has a bottom end, wherein the upper section has a first length measured from the top end to the live hinge, and the lower section has a second length measured from the live hinge to the bottom end, and wherein the first length is greater than the second length.

11. The support frame of claim 10, wherein the connector is a wire tie.

* * * * *